United States Patent [19]

Brown

[11] 4,433,882

[45] Feb. 28, 1984

[54] MODULAR, STACKABLE, SUSPENDABLE DRAWER CABINET

[76] Inventor: George L. Brown, 419 E. N St., Benicia, Calif. 94510

[21] Appl. No.: 362,552

[22] Filed: Mar. 26, 1982

[51] Int. Cl.[3] ..... F16B 12/00; A47B 88/00

[52] U.S. Cl. ..... 312/111; 312/330 R; 312/338

[58] Field of Search ..... 312/111, 330 R, 334, 312/337, 338, 339, 341 R, 342

[56] References Cited

U.S. PATENT DOCUMENTS

| | | | |
|---|---|---|---|
| 1,573,608 | 2/1926 | Huffman | 312/330 R |
| 2,869,961 | 1/1959 | Gomersall | 312/339 |
| 3,203,744 | 8/1965 | Batke et al. | 312/111 |
| 3,744,869 | 7/1973 | Anderson et al. | 312/330 R |
| 3,751,127 | 8/1973 | Black, Jr. et al. | 312/111 |
| 3,762,788 | 10/1973 | Heller | 312/111 |
| 3,973,814 | 8/1976 | Entrikin | 312/330 R |
| 3,974,898 | 8/1976 | Tullis et al. | 312/111 |
| 4,129,347 | 12/1978 | Godtschalck | 312/330 R |
| 4,172,625 | 10/1979 | Swain | 312/330 R |

FOREIGN PATENT DOCUMENTS

| | | | |
|---|---|---|---|
| 262928 | 10/1967 | Austria | 312/334 |
| 2919876 | 9/1980 | Fed. Rep. of Germany | 312/330 R |

*Primary Examiner*—Victor N. Sakran

*Attorney, Agent, or Firm*—Harris Zimmerman; Howard Cohen

[57] ABSTRACT

A modular drawer cabinet includes a pair of generally rectangular cabinet shell members joined edge to edge to form a generally rectangular enclosure having one open end. A double sided edge molding is disposed to engage and retain the confronting edges of the cabinet halves, the molding extending continuously about two sides and one end of the cabinet. Within the enclosure, rectangular channel members are secured to the edge molding along the sides and closed end of the enclosure. Joined to the channel members which extend inwardly from the sides are a pair of drawer roller guides to support a drawer in translatable fashion. At each corner of the enclosure, a C-shaped brace extends vertically to support the weight of subjacent or superjacent enclosures. The corner braces of adjacent, stacked enclosures may be bolted together to form a self-supporting stack of drawer enclosures which may be suspended from above or supported from below.

9 Claims, 7 Drawing Figures

FIG _ 1
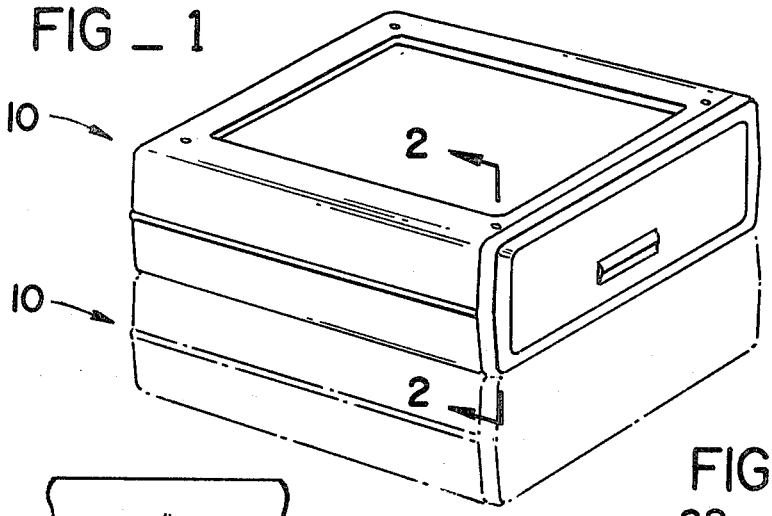
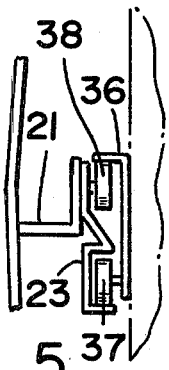
FIG _ 5
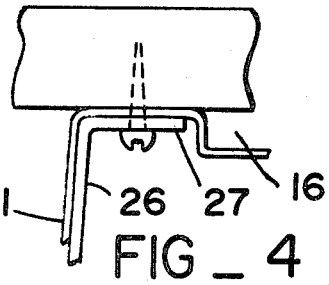
FIG _ 4
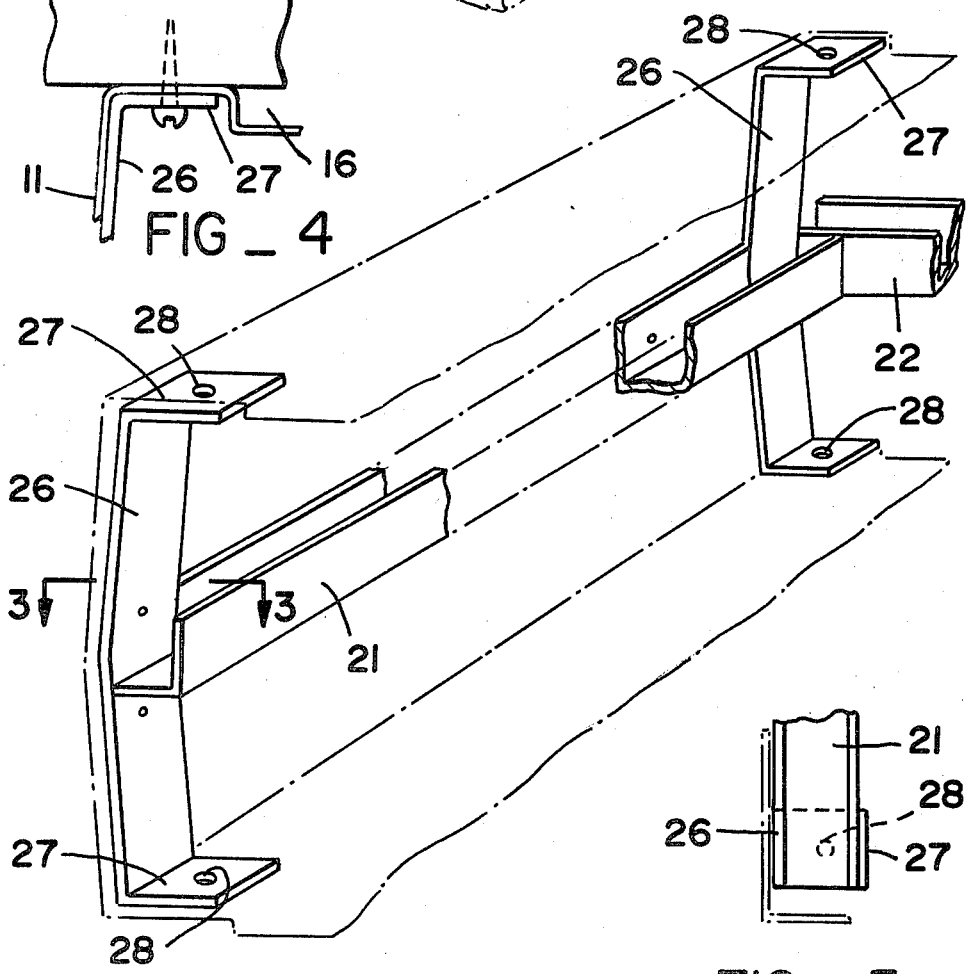
FIG _ 2
FIG _ 3

MODULAR, STACKABLE, SUSPENDABLE DRAWER CABINET

BACKGROUND OF THE INVENTION

It is known in the prior art to stack drawers, to increase storage space, and to make use of space otherwise unsuitable for storage. However, when the drawers are stacked in vertical fashion and supported from below, the combined weight of the upper drawers and the contents thereof may be sufficient to crush the lowermost drawers and their contents.

A plurality of drawers, each disposed in a cabinet to protect the contents thereof, may be disposed in vertically stacked relationship and connected together to be suspended beneath a shelf, counter, ledge, bed, or the like. However, if the drawer enclosures are not sufficiently reinforced, the weight of the lower ones will cause the upper ones to separate each from the other and from their superjacent supporting member, such as the aforementioned shelf, counter, or the like. The load problem may be less catastrophic but still severe, causing warping of the drawer cabinets and obstruction of free translation of the drawers.

SUMMARY OF THE PRESENT INVENTION

The present invention generally comprises a modular drawer cabinet which is light in weight and inexpensive to manufacture, yet which is sufficiently strong to be stackable and supported from above or below. The cabinets are adapted to be joined in nesting relationship, each one secured to the cabinets directly subjacent and superjacent thereto.

The modular drawer cabinet includes a pair of generally rectangular cabinet shell members joined edge to edge to form a generally rectangular enclosure having one open end. A double sided edge molding is disposed to engage and retain the confronting edges of the cabinet halves, the molding extending continuously about two sides and one end of the enclosure. Within the enclosure, rectangular channel members are secured to the edge molding along the sides and closed ends of the enclosure. Joined to the channel members are a pair of drawer roller guides to support a drawer in translatable fashion. At each corner of the enclosure, a C shaped brace extends vertically to support the weight of subjacent or superjacent enclosures. The corner braces of adjacent, stacked enclosures may be bolted together to form a self-supporting stack of drawer enclosures which may be suspended from above or supported from below.

A BRIEF DESCRIPTION OF THE DRAWING

FIG. 1 is a perspective view of the drawer cabinet of the present invention.

FIG. 2 is a partially cut-away perspective view taken along line 2—2 of FIG. 1.

FIG. 3 is a cross-sectional detail view taken along line 3—3 of FIG. 2.

FIG. 4 is a detailed cross-sectional elevation showing the drawer cabinet of the present invention supported in suspended fashion.

FIG. 5 is a detailed cross-sectional elevation showing a drawer guide and related supporting structure.

DESCRIPTION OF THE PREFERRED EMBODIMENT

The present invention generally comprises a drawer cabinet which encloses and protects a drawer mounted therein in slidably translatable fashion. A salient feature of the present invention is that the drawer cabinet is formed of light-weight and inexpensive vacuum-formed plastic, yet the drawer cabinets may be disposed in vertically stacked fashion and joined in a column of multiple units. This is due to the fact that each cabinet includes structural reinforcements which support the combined weight of the one or more other cabinets which are bearing thereon or suspended therefrom. Thus the drawer cabinet of the present invention is both lightweight and inexpensive, yet strong enough to be stacked in multiple units.

Figure 6:
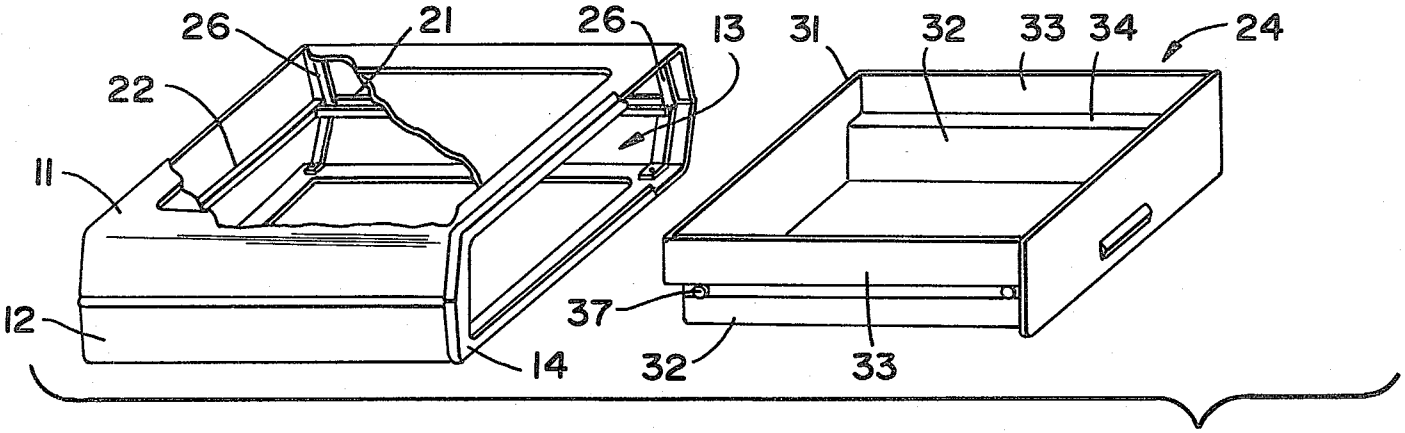
FIG. 6 is an exploded view of the drawer cabinet and drawer assembly.
Figure 7:
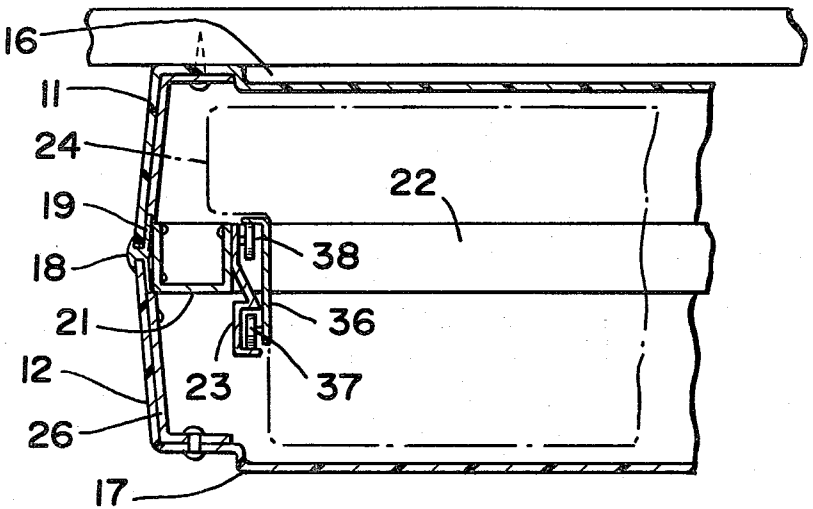
FIG. 7 is a cross-sectional elevation of one side of the drawer and cabinet assembly.

With reference to the accompanying figures, and in particular FIGS. 1, 6, and 7, each drawer cabinet 10 of the present invention is comprised of a pair of vacuum-formed plastic shells 11 and 12, each shell having a configuration of exterior surfaces corresponding to a hollow rectangular solid having one end open and one lateral side open. The shells 11 and 12 are disposed with their edges in confronting correspondence to form the rectangular cabinet 10 having an opening 13 extending through one end thereof. A generally rectangular collar member 14 is secured to the members 11 and 12 and disposed about the opening 13.

The member 11 includes a generally rectangular depression 16 formed in the laterally extending panel thereof, while the member 12 includes a generally rectangular protrusion 17 extending downwardly from the laterlly extending panel thereof. The protrusion 17 is adapted to be received in the depression 16 in socket fashion to prevent lateral shifting of cabinets 10 which are disposed in vertically stacked relationship, as shown in FIG. 1.

Each cabinet 10 also includes a double sided edge molding 18 which extends continuously about the sides and closed end of the cabinet 10. The edges of the members 11 and 12 are received in the opposed channels of the molding 18 and are securely held in place thereby. The molding 18 includes an inner panel 19 which is substantially wider than the outer welt of the molding, so that the edge portions of the members 11 and 12 may be secured to the molding 18 by rivets or the like extending through the members 11 and 12 and the panel 19.

The drawer cabinet also includes a pair of side reinforcing members 21 and an end reinforcing member 22. The reinforcing members 21 and 22 comprise generally rectangular metal channel members having similar cross-sectional configurations, as shown in FIGS. 2, 5, and 7. The reinforcing members extend generally parallel to and impinging upon the inner portion 19 of the edge molding. Indeed, the members 21 and 22 are secured to the interior surface of the drawer cabinet by the very same rivets or the like which also extend through the member 19 to secure the edge molding and the confronting edges of the members 11 and 12. Joined to the inner legs of the reinforcing members 21 are a pair of cabinet roller tracks 23, known in the prior art, for supporting a drawer 24 in easily translatable fashion.

Each drawer cabinet 10 also includes a quartet of corner reinforcing members 26, as shown for example in FIG. 2. Each of the members 26 includes a generally vertically disposed narrow web portion, and a pair of arm portions 27 extending laterally and integrally from opposed ends of the members 26. Each of the arms 27 includes a hole 28 extending therethrough. The web portion of each of the members 26 is provided with a slight lateral bend at a medial portion thereof, so that the web portion conforms to the inner surfaces of the joined sides of the members 11 and 12. The web portions of the members 26 are secured to the members 11 and 12 by rivets extending therethrough. The arms 27 are adapted to impinge upon the inner surfaces of the upper and lower lateral panels of the members 11 and 12, as shown in FIG. 7. The cabinets 10 are provided with holes in the top and bottom which are aligned with the holes 28 of the members 26, so that bolts or screws may extend therethrough.

As shown in FIG. 7, screws may be disposed to extend through the holes 28 of the upper portions 27 of the members 26, the screws being received in the underside of a shelf, work bench, or the like. It may be noted that further cabinets 10 may be secured to the unit shown in FIG. 7 in subjacently depending fashion, employing bolts extending through the aligned holes 28 of vertically adjacent units to join the units together. It may be appreciated that the members 26 carry the load forces associated with the weight of the cabinets 10 and the contents of the drawers, so that the relatively weak vacuum-formed members 11 and 12 are not burdened by stresses which are beyond their design tolerances. As shown in FIG. 2, the side legs of the channel members 21 are mortised to accommodate the members 26 disposed at both ends of the member 21.

The drawer member 24 comprises a vacuum-formed plastic shell 31 of generally rectangular configuration and defining an upwardly opening coffer. The side walls 32 of the drawer include an upper portion 33 of increased width, which is joined to the remaining portion of the side walls by a flange 34.

Secured to the exterior surface of the side walls 32 of the drawer are a pair of drawer roller tracks 36, as shown in FIG. 7. As known in the prior art, the drawer track 36 includes a roller 37 which bears upon the cabinet track 23, while the cabinet track 23 also includes a roller 38 which supports an outwardly extending portion of the track 36. As shown in FIG. 7, the member 36 is disposed directly below the flange 34 and in supporting relationship thereto. Thus all of the weight of the drawer 24 and its contents is transferred to the pair of drawer guides 36, and thence to the cabinet track 23. This weight is then transferred to the panel members 21 and thence to the vertical support members 26. It may be appreciated that little or none of the load is borne by the vacuum-formed plastic members of the present invention.

It may be appreciated that the drawer cabinet 10 of the present invention may also be disposed in vertically stacked relationship and supported from below. Here again, the load factor caused by the weight of vertically stacked cabinets and their contents is borne by the support system shown in FIG. 2; i.e., the vertical stresses are carried by the members 26 and any lateral stresses are carried by the reinforcing members 21 and 22.

I claim:

1. A modular drawer cabinet adapted for vertically stacked assembly, comprising a thin, non-load-bearing cabinet shell defining a generally rectangular, hollow, closed solid having one open end and four vertically extending vertices, a drawer disposed within said cabinet, means for supporting said drawer in translatable fashion from said open end of said cabinet, means for transferring the weight load of said drawer and its contents directly to adjacent stacked modular drawer cabinets, said last mentioned means including a plurality of corner braces, each extending generally vertically within said cabinet and disposed in one of said vertices, means for connecting the corner braces of vertically adjacent modular drawer cabinets without applying said weight loads to the respective cabinets, said means for supporting said drawer including drawer track means disposed within said cabinet and supported by said corner braces.

2. The modular drawer cabinet of claim 1, wherein said cabinet includes a pair of cabinet shell members, each comprising a generally rectangular coffer member having an open end and an open lateral side, and means for joining said shell members with said open lateral sides joined and said open ends adjacent.

3. The modular drawer cabinet of claim 2, wherein said last mentioned means includes a double-sided edge molding for engaging confronting edge portions of said shell members, said edge molding extending continuously about the closed end and two sides of said cabinet.

4. The modular drawer cabinet of claim 1, wherein said means for supporting said drawer include a plurality of channel members secured to the inner surfaces of the closed end and sides of said cabinet, and a pair of cabinet roller tracks secured to said channel members at opposed sides of said cabinet.

5. The modular drawer cabinet of claim 1, wherein said corner braces each include a vertically extending web portion and laterally disposed end portions extending from the opposed ends thereof.

6. The modular drawer cabinet of claim 5, wherein said end portions each include a hole extending therethrough, and a plurality of holes extending through said cabinet, each aligned with one of said holes in said end portions.

7. The modular drawer cabinet of claim 6, wherein said means for joining adjacent cabinets includes bolt means extending through said holes in said end portions and said cabinets.

8. The modular drawer cabinet of claim 3, further including a plurality of channel members, each disposed within said cabinet and adjacent to the closed end or sides of said cabinet, said channel members being joined to the inner extent of said double-edge molding.

9. The modular drawer cabinet of claim 8, wherein said channel members are mortised at end portions thereof to accommodate said corner braces.

* * * * *